United States Patent [19]

Langseder

[11] 4,424,698

[45] Jan. 10, 1984

[54] TOOL FOR COINING

[75] Inventor: Neal E. Langseder, Rolling Meadows, Ill.

[73] Assignee: American Can Company, Greenwich, Conn.

[21] Appl. No.: 379,863

[22] Filed: May 19, 1982

[51] Int. Cl.[3] ..... B21D 22/00

[52] U.S. Cl. ..... 72/354; 72/475; 413/14; 413/66

[58] Field of Search ..... 413/12, 14, 16, 25, 413/66, 67, 56; 72/354, 475

[56] References Cited

U.S. PATENT DOCUMENTS

| | | | |
|---|---|---|---|
| 3,361,102 | 1/1968 | Porese | 413/14 |
| 3,366,086 | 1/1968 | Froze | 413/14 |
| 3,557,425 | 1/1971 | Scharf | 413/14 |
| 3,580,200 | 5/1971 | Cvocho | 413/14 |
| 3,583,348 | 6/1971 | Broin | 413/14 |
| 3,993,010 | 11/1976 | Taniuchi | 413/12 |
| 4,211,335 | 7/1980 | Langseder | 413/12 |

*Primary Examiner*—Leon Gilden

*Attorney, Agent, or Firm*—Paul R. Audet; Stuart S. Bowie

[57] ABSTRACT

Disclosed is a tool for use in a high speed progressive die which includes a spring loaded retaining member and cooperating recess surface to first position and hold the progression carried partially formed piece part prior to a forming operation which severely works the metal tending to warp, distort and lock same within the tool.

7 Claims, 6 Drawing Figures

FIG. 4
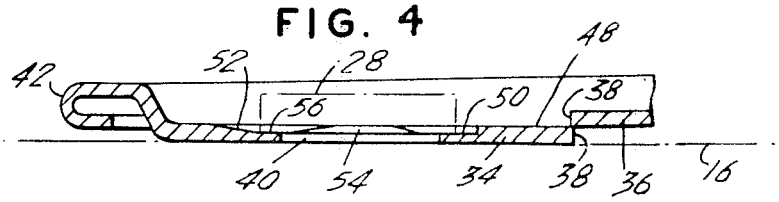
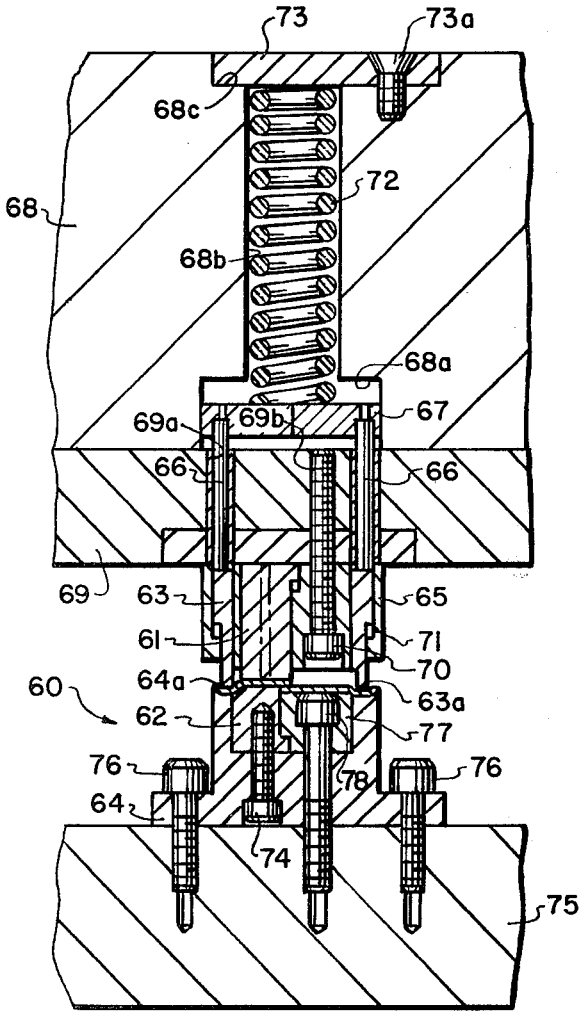
FIG.5
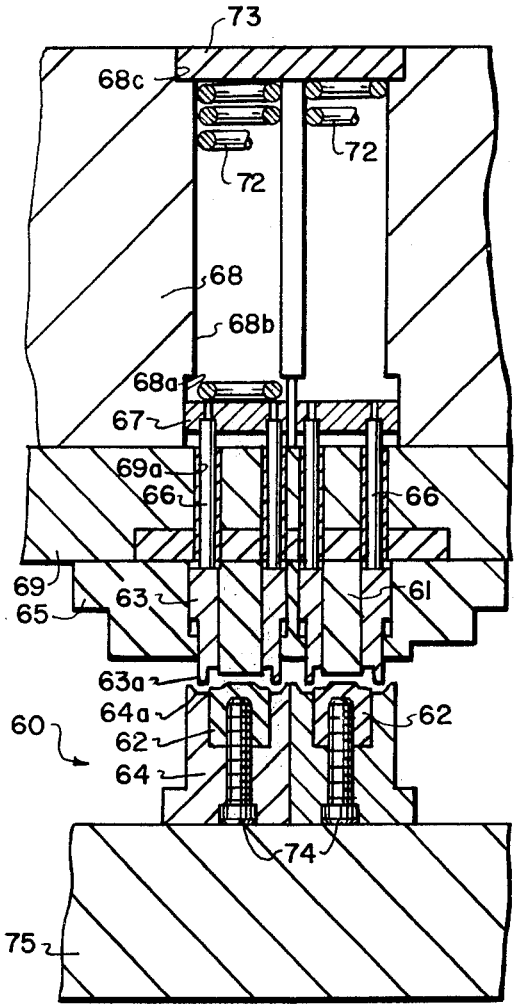
FIG.6

TOOL FOR COINING

BACKGROUND OF THE INVENTION

The market for metal containers has developed widely in recent years due in part to the introduction of the easy open end. While the easy opening feature has been shown to be both effective and convenient, it has given rise to a collateral problem of littering, since traditionally the easy opening feature was pulled free from the container to expose the contents and then subsequently discarded. The indiscriminate disposal of the pull tabs is not only unsightly, but can also present a safety hazard. Further, the relatively small size of the separated tab presents a challenge to those concerned with the collection and recycling of waste material. The solution to this problem resides in a non-detachable tab and preferably a tab which is compatible with the end closure and is easily recycled.

While the industry has addressed this problem by developing a number of closure structures, one of the more successful has been a can end which employs a retained lever tab. In this structure, the tab is joined to the container end by a tongue or flap which is lanced in the web of the tab, and which serves as a hinge or connecting strip. Typically, the tip of the tongue is apertured and staked to end by means of a rivet integral with end. Since the tab functions by levering open a scored portion of the end panel, it must be sufficiently rigid to prevent distortion of its curled rim when leverage is applied to the lift end of the tab to effect rupture and displacement of the scored panel. At the same time, the tongue of the tab must be sufficiently bendable to permit the user to open the container and subsequently bend the tab back out of the way into a position of repose. The situation is aggravated by the user's inclination to fatique the tab by bending it back and forth in an effort to free the tab from the container in accordance with past practice.

Typically, tab rigidity is provided by use of heavy aluminum tab stock and by curling the edges of the stock to form a tab rim. Such a structure, however, results in a tab tongue which is one thickness of metal, lacks bendability and is prone to fracture when subjected to repeated bending, as may be encountered when it is pivoted forward to open the end and then subsequently bent backward to fold the tab out of the way. Fracture of the tongue generally occurs between the terminal ends of the lance and the rivet hole or tongue aperture.

The lack of bendability of the tab tongue can be overcome in part by a more elaborate tab structure, wherein a retaining strip of plastic or ductile aluminum is interleafed into the folds of the tab nose, thereby providing a flexibility and a fracture resistant linkage between the tab and the end. Such a structure requires insertion of a premium tie strip and appreciable press time for fabrication.

Alternative structures have been proposed using a soft ductile alloy for the tab, but with a more complex configuration as a means for achieving rigidity. In another instance, tin-plated or zinc coated steel has been suggested as a material of construction.

The problems of material recycling and raw edge corrosion or alternatively of increased manufacturing cost, which are attendent with these structures, are not readily resolved. Therefore, an easy opening end closure having a central panel wall, a peripheral flange which joins via double seaming to a container is manufactured with an integral rivet and a displaceable panel located radially outwardly of the rivet, and being defined by a score line. For opening there is a lever tab held to the end panel by the rivet such that opposite ends of the tab are apart from the rivet. There is an opening tab nose end and a tab lifting portion with a central web therebetween. The central web is lanced to form a tongue and the tongue is apertured to receive the rivet.

Portions of the tongue are coined to control the mode of bending of the tongue when the tab is pivoted forward about the rivet such that the nose end contacts the displaceable panel. The exact details of the coining position and location are disclosed in the Langseder U.S. Pat. No. 4,211,335 and in the Radtke U.S. Pat. No. 4,210,257. The nondetachable tab lever is disclosed in U.S. Pat. No. 3,967,752 and the integral rivet construction is disclosed in U.S. Pat. No. 3,361,102. The present disclosure relates to techniques for manufacturing the coined tab tongue in a high speed commercial operation. It is recognized that the coining operation reduces the thickness of the metal while improving its strength by encouraging bending along preferred lines or in preferred areas. Finally, it is advantageous to manufacture the tab by feeding a strip of tab stock into the progressive tab die of a press, in which the following sequence of operations is carried out at speeds producing 500 tabs per minute. In a first progressive die station the rivet aperture is punched in the strip, which is then in a second station panelled to form the web of the tab, with the rivet aperture included in the web toward the nose end. In a third station the strip is sheared outward of the web to form a tab blank with a nose end and a lift end, but the tab blank is carried by a tie piece remaining between it and the strip at the center of the lift end. In a fourth station the edges of the blank are wiped to curl the tab rim. In a fifth station the web of the tab is lanced to form a tongue with the aperture in the tongue tip and the tongue root formed proximate the tab nose. In a sixth station the tongue is displaced from the web plane by the lacing, and the portion of the tongue proximate the root is reinserted into the web plane whereas the portion proximate the tip remains out of the web plane. In the seventh station the coining takes place when the tab is struck to form the band of thinned metal circumscribing the aperture. In the eighth station the curling of the rim is completed and the aperture repunched to the desired size and orientation.

The coining operation displaces metal outwardly since the change in thickness of the stock is accompanied by an increase in size of the panel in the plane normal to the direction of the coining. Such a condition is of concern with respect to jamming in the progressive die station wherein the coining of the aluminum lanced tab tongue is performed. Various approaches have been tried to control the position of the tongue during coining. The cutout for the rivet island could be increased to eliminate the need for offsetting the tab tongue rivet island and removal of more metal in the cutout is preferred over spreading of the rivet island to the sides of the tab tongue. The cutout piece of the metal would have to be removed from the die station and it would be difficult to handle a small sliver of metal in a high speed progressive die. For example, piloting the tongue by means of a pin through the rivet hole is unacceptable because during coining the expansion of the metal tends to close the hole and lock the tab to the pin. A rubber clamp pad positioned to hold the tab during coining has too much give in the plane of the coining particularly when the coining is not symmetric and the forces of the tooling tend to shove the tab tongue sideways. No positive means of holding the tab tongue sufficiently to control the location of the coining was apparent and since the tongue is held by the remaining uncut metal which ultimately becomes the hinge for the tab and the tab is held in the progression by a fragile tie located at the left end of the tab. Consequently, the tab is free to swing relative to the strip of the progression and the tongue is capable of being moved sideways relative to the web of the tab. The progressive die used to totally form the tab must be located with respect to the tab during each operation. In the past the criticality of position was only with respect to the tab but with coining the position of the tongue is particularly critical.

It is recognized that the coining operation will expand the metal of the tongue area of the tab in the horizontal plane (relative to the tooling axis) such that the tongue would lock or jam the tooling. If the tongue jams, stripping becomes difficult and prevents high speed manufacture. While the coining is valuable for the reasons stated in the prior art, it is impossible to produce the preferably coined tab tongue without an improvement to the tooling.

OBJECTS OF THE DISCLOSURE

It is therefore an object of the present disclosure to have tooling which can accurately reduce the thickness of the lanced part of the tongue by coining at high speed.

It is additionally an object of the present disclosure to provide tooling which insures a positive location of the lanced tab tongue during coining by resiliently holding the tab in position.

It is a further object of the present disclosure to describe tooling which allows the easy stripping of the coined tab and in particular the tongue portion from the tooling.

It is yet another object of the present disclosure to show tooling which permits displacement of the rivet island portion of the tab tongue from the center web of the tab from which it is cut so as to allow coining of the tongue without the coining causing a problem, such as buckling, distortion or locking of the rivet island.

SUMMARY OF THE DISCLOSURE

A progressive tab die station which permits the partial coining of the tab is disclosed. It has been found that any other pilot or retention during coining other than a spring loaded clamping pad permits too much variation in the location or position of the tongue and it will move during the coining operation and thereafter jam in the tooling. That is to say that, during coining the tongue is inevitably forced in one direction and this action displaces the tongue out of its desired position, because coining squeezes the metal and thins the cross-sectional thickness causing the displaced metal to squirt outwardly. Any clearance that existed prior to coining between the web and the tongue are closed and the tongue wraps and buckles making it difficult to strip or remove the tab from its work station at the speeds at which coining is performed. The tabs are converted from thin metal strip to the completed tab at 500 per minute and so the positioning of the coining such that stripping of warped tabs is difficult in the short amount of time available.

This disclosure teaches a technique of coining the tongue formed by the U-shaped lance or cutout for defining the rivet island portion of the tab without the expansion of the coined metal closing the cutout and jamming, locking or distorting the resulting coined tab tongue. It is essential to have a cutout as the function of the tab is dependent upon the cut. More specifically, the tongue is an open "U"-shape cut placed in the web of the tab near the nose end of the tab with the open end of the "U" pointed toward the nose end. The rivet hole is located near the open end of the "U" between the ends of the legs of the "U". The legs of the "U" are not straight but curve inwardly toward the rivet hole; these curved terminations are called the recurves and the prevent the lanced cutout from tearing.

To permit controlled displacement of the metal in the cutout rivet island of the tongue, the tongue position relative to the plane of the web is controlled by the tooling. That is to say that offsetting of the tongue is used so that the portion of the tongue, the rivet island, (near the lift end of the tab) is pressed out of the plane of the tab central web. At the same time the portion of the tongue. The legs of the "U" and their recurves, closest to the tab nose is retained in the panel. Retaining the nose end portion of the lanced tongue is essential so that during coining the displaced metal is controlled to occur along the tab axis (the center line drawn along the longitudinal center across the rivet hole from the nose end to the lifting end of the tab) and in the area of the rivet island of the cutout. The sides of the "U" shape cutout about the rivet are retained in their plane during coining so there is very little lateral spread. Lateral spread causes fractures at the edges close to the lance or cut. The tooling allows the coining to take place close to the edge of the cut without fracturing the metal at the edge.

Another benefit of the offsetting aids the high speed production of the coin tab in a progressive operation. The controlled movement of the rivet island metal during coining prevents it from locking against the center web of the tab from which it was cut since that locking would make the tab difficult to lift as when opening a displaceable panel. More particularly, offsetting of the rivet island portion prior to coining prevents the buckling of that part of the tab tongue.

The coining die used to hold the rivet island during coining includes a coin punch and a coin anvil. To position the tab there is a spring loaded retaining punch and conjugating die surface. The normal movements of a tab which is not so held by the spring loaded retaining punch and conjugating die surface would make stripping at speed difficult. Here the strip carried tab and the hinge portions carrying the lanced tongue is accurately positioned by the addition of a spring loaded member and its cooperating die surface.

BRIEF DESCRIPTION OF THE DRAWINGS

FIG. 4 is an enlarged sectional view of the tab taken along line 4—4 of FIG. 3, and showing the rivet head in phanton and the tongue as displaced from the plane of the web during coining.

FIG. 5 is a partial side cross sectional view of the punch and die in the seventh station of the progression used for coining the tab tongue, and FIG. 6 is a partial end cross sectional view of the tooling showing the double die arrangement used in each station and in this particular operation for coining the tab tongue.

DETAILED DESCRIPTION OF THE ILLUSTRATED EMBODIMENT

Figure 1:
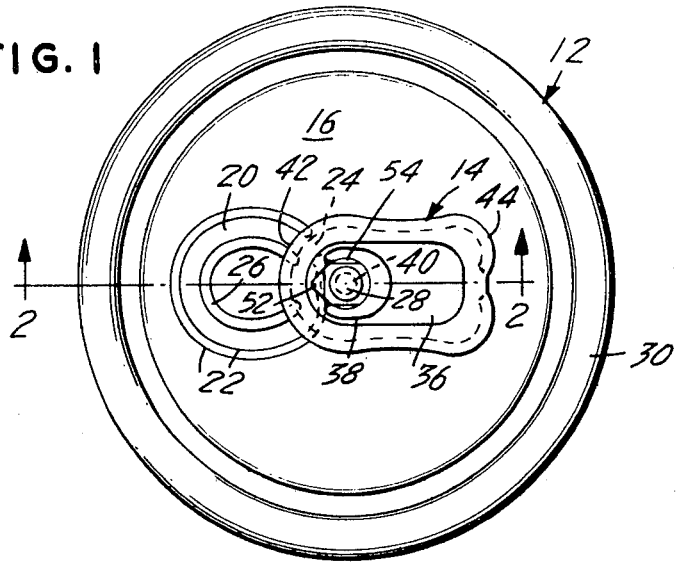
FIG. 1 is a plan view of an end closure with a tab manufactured as herein disclosed.
Figure 2:
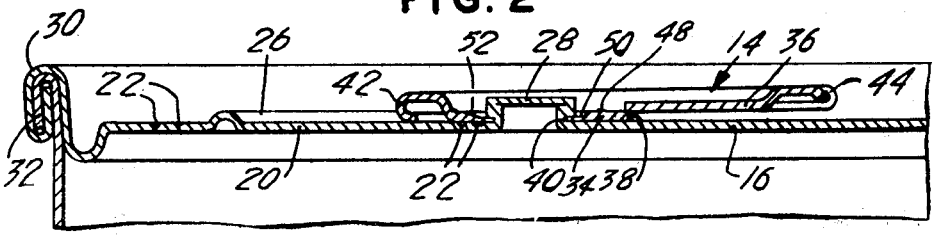
FIG. 2 is an enlarged fragmentary sectional view taken along the line 2—2 of FIG. 1.

Turning now in to FIGS. 1 and 2 of the appended drawings, there is an easy open end closure 12 with a non-detachable fracture resistant lever tab 14. The closure includes a central panel wall 16 with a displaceable pour panel 20 The displaceable panel 20 is substantially defined by a continuous score line 22 with an unscored portion 24 lying between the extremities of the scoring. The unscored portion serves as a hinge for the displaceable panel 20 allowing it to remain attached to the panel wall 16 even after opening. The displaceable pour panel 20 is additionally provided with an upbead 26, which provides structural reinforcement for the panel. The non-detachable fracture resistant tab 14 is a lever type opening device with an aperture 40 for staking to the central panel by means of rivet 28, which is an integral part of the panel wall 16 preferably formed in accordance with the method of U.S. Pat. No. 3,361,102. The end closure 12 is joined to the container wall, as shown in FIG. 2 by a peripheral flange 30, which is folded over the rim 32 of the can body to form a double seam in accordance with conventional practice.

Figure 3:
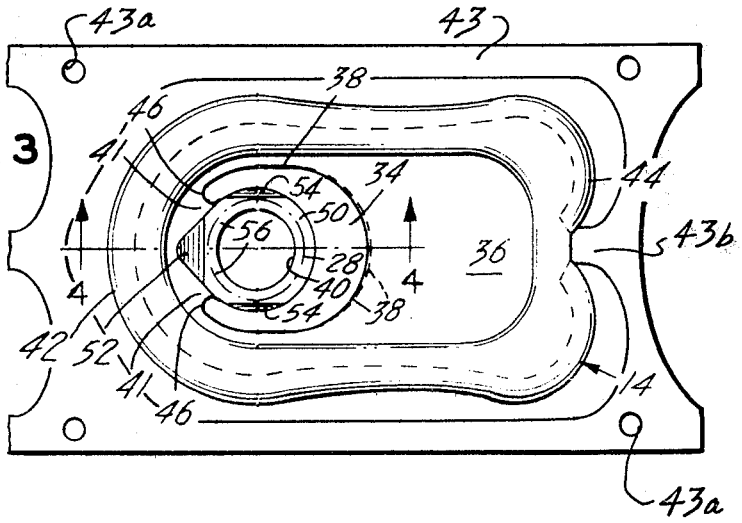
FIG. 3 is an enlarged view of the tab shown within the progressive die carrying strip.

The tab 14, as best seen in FIG. 3, has a tongue 34 which is formed by lancing the tab web 36 in a U-shaped configuration 38, which terminates in recurves 46 to reduce the chance of web tear at the ends of the "U" 38 during the opening operation. The tab is formed from 0.0185" tab stock, with a curled rim to make it sufficiently rigid to effect the panel opening without distorting the tab 14. The tab 14 has a longitudinal central axis which would coincide with section line 44 shown in FIG. 3. This is an outwardly disposed tab nose 42 at one end of the axis, and an inwardly disposed lift 44 at the other end of the axis. The tab tongue 34 has its root 41 formed by the open end of the lanced "U" 38, proximate the tab nose 42 lying between the extremities of the lancing. The tip of the tongue is inwardly directed toward the lift end 44 and has aperture 40 to receive integral rivet 28.

A band 50 surrounding the aperture 40 can be fully coined to a maximum depth to increase the bendability of the tongue. The coining reduces the thickness of the tab stock from 0.0185" to between 0.0130" and 0.0100" say 0.0115". The resulting coined tab tongue 34 is rigid, without coining, the tab tongue 34 is susceptible to fracture in the area of the tongue root 41 where a hinge or bend line is formed. By reducing the thickness of the stock in the region of the bend line, it is possible to increase the bendability of the tab tongue 34 without seriously impairing its overall rigidity. Bendability of the tongue 34 can be increased by introducing other coined areas of the tongue 34 with asymmetric placement and/or co-operating graduated coining extending from the upper surface 48 of the web to the band 50. In developing contoured surfaces, particular attention is given to stress concentrations such as sharp corners, or intersecting planes. An outward transitional plane 52 being triangular in shape and joins the web 36 proximate the tab nose 42 with the coined band 50. Additional transitional planes 54 can be located along the lateral extremities of the band 50 and fully coined segments 56 of band 50 can separate the outward and lateral transitional planes. These fully coined segments 56 are substantially tangent to the reverse curl portions of the lancing. The outward and lateral transitional planes 54 co-operate to urge the formation of the bend line of the tongue 34 in the fully coined segment 56.

In operation, the lever tab is employed to open the end closure by lifting the curled rim of the tab lift end 44. As the lift end 44 is raised, the tab nose 42 bears against the displaceable 20 pour panel proximate the ends of reinforcing bead 26 at the same time lifting the panel bight of the "U" 38 to put the metal about the "U" 38 into shear. As the tab is pivoted forward to first rupture the score line 22 and then to inwardly displace the displaceable panel 20, the tab tongue 34 is distended in the region of the outward transitional plane 52, and a bend line is formed in the area 56 of maximum coining.

In manufacture, lever tab 14 can be formed from aluminum tab stock strip such as 5082-H19 or 5182-H19 of 0.0185" thickness. The strip 43, in FIG. 3, is fed into a progressive tab die where it is first punched at appropriate intervals to provide rivet holes or apertures 40, and carrying holes 43*a* for the progression strip 43. The aperture tab stock is then panelled to form the tab web 36. The tab strip is subsequently sheared into discrete tabs carried by a tie piece 43*b* at the lift and 44 of the tab 14. The tab blanks are carried by the strip 43 to the next press station, where the edges of the tab blanks are wiped to form the rim of the tab 14 as a first step in the tab rim curling process. The web of the tab blank is then lanced in a generally U-shaped configuration 38 with recurves 46 at the terminal portions legs of the "U". The lancing operation will leave the tongue 34 displaced out of the plane of the web 36, see FIG. 4. The portion of the tongue 34 proximate the root 41 is reinserted into the plane of web 36 whereas the portion of the tongue 34 proximate the bight of the "U" 38 remains out of the plane of the web 36 as best seen in FIG. 4. The displaced tongue tip is caused to undershoot the web 36. The completed tab when mounted on an end panel will be disposed with the lift end raised slightly to facilitate use. The band is fully coined to a residual thickness of 0.0130"–0.0100" say 0.01115". The outward transitional plane 52 which is inclined to the upper surface 48 of the web at an angle of 6°–7°, exhibits graduated coining ranging from no coining at the junction with the web surface 48 to full coining with a residual thickness of 0.0130"–0.0100" say 0.0115" at the junction with band 50.

In FIGS. 5 and 6 the tooling 60 used to form the tab 14 by coining the tab tongue 34 is disclosed and in the preferred embodiment of the tooling 60 is in the seventh station of a progressive die. More specifically, the coining tools generally consist of a coin punch 61 axially aligned with a coin anvil 62. The punch 61 and anvil 62 are positioned to form in the manner detailed herein the areas surrounding the rivet aperture 40. In doing so, the aperture 40 tends to close inwardly and the tab tongue 34 expands outwardly during the reduction in thickness caused by the coining. The tab strip 43 carries the tab 14 by means of a tie piece 43*b* disposed at the lift end 44 of the tab 14 and connecting to the remaining skelton of the tab strip 43. The partially formed tab 14 is thus carried through the progressive die stations. The tie piece 43*b* is away from the rivet end of the tab 14 such that the tab 14 is relatively free to swing from one side to side about the tie piece 43*b* and with respect to the skelton of strip 43. Moreover, the lanced tongue 34 is held to the web 36 of the tab 14 by the root 41 remaining between the terminal portions of the recurves 46. Thus, even the tab tongue 34 is not rigidly held with respect to the web 36 of the tab 14.

It should be clear that at the speeds which these tabs are formed displacement of the tongue 34 relative to the coin punch 61 and coin anvil 62 is a likely occurrence before or during coining.

In the present disclosure there is shown in FIGS. 5 and 6, a spring loaded retaining punch 63 designed to cooperate with a die block 64 having a recess surface 64*a* adapted to receive the periphery of the tab 14. More specifically, the wiped edges of the tab blank which form the rim. The spring loaded retaining punch 63 is supported by means of a punch block 65 which holds the spring loaded retaining punch 63 in position to align the tab 14 just prior to being coined between the coin punch 61 and the coin anvil 62. More particularly, the spring loaded retaining punch 63 is free to ride axially independent of the coin punch 61 by means of the pins 66 by which it is carried. Pins 66 depend from a pin plate 67 which is carried in a recess 68*a* of punch shoe 68. Between the punch shoe and the spring loaded retaining punch 63 is a punch holder 69 which guides the pins 66 through suitable bored openings 69*a* and which supports the punch block 65 by means of a threadhole 69*b* which cooperated with a bolt 70 that holds the panel punch 71 (see FIG. 5).

Above the pin plate 67 there is a retainer spring 72 which is a compression spring captured within the punch shoe 68 in a cylindrical opening 68*b* extending through the punch shoe 68 to a recessed opening 68*c* provided to receive a spring hold down plate 73 and its associated retaining screw 73*a*. Consequently, the spring loaded retaining punch 63 is free to move axially relative to the coin punch 61 to and away from the coin anvil 62 in response to loads imposed upon the spring loaded retaining punch 63 as it is first brought to bear on the inner opening groove formed by the upwardly wiped rim of the tab 14. More specifically, the working portion of the spring loaded retaining punch 63 includes a shaped tab contacting edge 63*a* which neatly conjugates with the groove formed just inside the wiped edge of the tab rim.

The coin anvil 62 is carried in a die block 64 which includes a through bolt 74 that affixes coin anvil 62 to the die block 64. The die block 64 is held to the die shoe 75 by means of die block flange bolts 76. Adjacent the coin anvil 62 in the die block 64 is a panel insert 77 which is held by a bolt 78 that extends down through the panel insert 77, through the die block 64 and into the die shoe 75 so that the panel insert 77 is clamped into the die block 64. During the operation of the seventh station of the progressive die of the preferred embodiment, the tooling 60 shown in FIGS. 5 and 6 and, in particular, the coin punch 61 moves toward the coin anvil 62 in a controlled fashion in a manner well known to skilled artisans such that spring loaded retaining punch 63 is first brought into contact with the tab 14 to hold and position same.

Once the spring loaded retaining punch 63 is firmly against the tab 14 such that it is held within the die block recess surface 64*a* the coined operation takes place as coin punch 61 bears upon the tongue 34 and presses same against coin anvil 62. The force of spring 72 is applied through pins 66 to spring loaded retaining punch 63 to hold the punch edge 63*a* against the tab 14 while same rests in recess 64*a*. Because the tongue is displaced at the bight end of the "U" 38 expansion during coining tends to extend in the direction of that free edge of the lanced or cut "U" 38. The portion of the tongue 34 near the recurves 46 is restrained by being in the same plane as the web and similarly the legs of the "U" 38 are restrained from expansion such that the coining squirts the metal outwardly in the direction of the displaced undershooting tongue.

It can be seen that a means and tool are shown and explained for holding a portion of a tab in position prior to and during the coining of a part thereof. The tab 14 while free to swing relative to its progression strip 43 and the tongue while free to move relative to the web 36 from which it was cut are positioned such that its alignment with the coin punch 61 and the coin anvil 62 are controlled. Those skilled in the art of tooling for high speed progressive die will no doubt appreciate minor refinement to the shape of the components which will enable changes in structure not related to the substance of the present invention as covered by the claims.

What is claimed is:

1. A tool for coining a portion of a progressively formed part carried by its progression strip and connected thereto at one end by a flexible tie piece and the portion of the part to be coined having been lanced and bent sufficiently to be displaced from the plane of the part where the tool includes:

a coin punch with a working surface mounted to move along an axis of a station for performing the progressive punch and die operation of coining the part captured thereunder, a coin anvil aligned along said axis to support a portion of the part beneath said punch during coining in the progressive punch and die operation, a resiliently biased member carried about said coin punch and extending beyond said working surface thereof to first contact another portion of said part in advance of contact by said working surface, and a recess surface about said coin anvil shaped to receive said other portion of said part to support same in position during coining between said coin punch and coin anvil to assure that said portion to be coined is aligned relative to said axis.

2. The tool of claim 1 wherein said resiliently biased member is supported for controlled axial movement by a plurality of pins carried for movement relative to said coin punch and said pins being biased outwardly of said coin punch by a compression spring to assure preliminary contact with the said other portion to position same by pressing it into said recess surface.

3. The tool of claim 1 wherein said resiliently biased member has a shaped contact edge fashioned to fit said other a portion of the part for positioning same and said recess surface has a mating shape designed to receive said other portion of the part when said member contact surface biases said other portion into said recess surface.

4. The tool of claim 1 wherein said part is a tab for opening a displaceable panel in a closure end, and said other portion of said part is the partially formed rim and adjoining groove thereof.

5. The tool of claim 4 wherein said portion of said part to be coined is the tongue of said tab and said tongue is during coining expanded primarily in the direction of the displaced lanced portion.

6. The tool of claim 5 wherein said axis is positioned at the end of said tab away from said tie piece.

7. A method for coining a portion of a progressively formed part while same is carried by its progression strip and connected thereto by a flexible tie piece and the portion of the part to be coined having been lanced and bent sufficiently to be displaced from the plane of the part wherein the following steps are used, positioning the part of a coin anvil and associated supporting recess shaped to receive at least a portion of said part and align same relative to the axis of said anvil, pressing said portion of said part into said recess by means of a resiliently biased member carried about a coin punch and aligned to contact and press said portion into said recess prior to coining, holding said portion in said recess by means of the clamping of said resiliently biased member against said portion and said recess during coining, and carrying a coin punch along said axis within said member to engage said clamped part at another portion thereof resting upon said coin anvil.

* * * * *